United States Patent [19]

Korn

[11] Patent Number: 4,602,818

[45] Date of Patent: Jul. 29, 1986

[54] APPARATUS FOR THE ATTACHMENT OF A LOWER BACK SUPPORT UPHOLSTERY TO A CHAIR

[75] Inventor: Heinrich Korn, Gersthofen, Fed. Rep. of Germany

[73] Assignee: Röder GmbH Sitzmöbelwerke, Fed. Rep. of Germany

[21] Appl. No.: 570,503

[22] Filed: Jan. 13, 1984

[30] Foreign Application Priority Data

Jan. 13, 1983 [DE] Fed. Rep. of Germany ... 8300753[U]

[51] Int. Cl.[4] ..... A47C 7/02

[52] U.S. Cl. ..... 297/452; 297/291; 297/300; 297/460

[58] Field of Search ..... 297/452, 460, 285, 299, 297/300, 291, 293, 264

[56] References Cited

U.S. PATENT DOCUMENTS

| | | | |
|---|---|---|---|
| 960,607 | 6/1910 | Wersel, Jr. | 297/293 |
| 1,064,181 | 6/1913 | Taft | 297/293 |
| 2,649,136 | 8/1953 | Eames | 297/285 X |
| 2,796,920 | 6/1957 | Cowles | 297/460 R |
| 3,059,971 | 10/1962 | Becker | 297/353 |
| 3,295,889 | 1/1967 | Lorenz | 297/299 |
| 4,157,203 | 6/1979 | Ambasz | 297/285 X |
| 4,468,067 | 8/1984 | Jenkins | 312/257 SK |

FOREIGN PATENT DOCUMENTS

| | | | |
|---|---|---|---|
| 2651843 | 5/1978 | Fed. Rep. of Germany | 297/284 |
| 1137552 | 12/1968 | United Kingdom | 297/285 |

*Primary Examiner*—James T. McCall

*Attorney, Agent, or Firm*—Wigman & Cohen

[57] ABSTRACT

An apparatus for the attachment of a lower back support upholstery by means of a spring to a back rest support, which is a four-sided tube. Preferably there are three springs formed from rubber and metal and which are arranged in an isosceles triangle. Access holes in the four sided tube facilitate the attachment of the springs.

12 Claims, 3 Drawing Figures

APPARATUS FOR THE ATTACHMENT OF A LOWER BACK SUPPORT UPHOLSTERY TO A CHAIR

BACKGROUND OF THE INVENTION

The invention relates to an apparatus for the attachment of a back rest support upholstery to a chair.

In a known apparatus of the above-mentioned type, the back rest has a back rest support manufactured from a bar, in the manner of a bow spring. A back rest support carrier, which is also made of spring steel and to which the lower back support upholstery is connected, is arranged between the shanks of the back rest support, so that it can yield essentially independently of the back rest in a horizontal direction. See U.S. Pat. No. 3,059,971.

SUMMARY AND OBJECTS OF THE PRESENT INVENTION

The object of the present invention is to create an apparatus in which the lower back support upholstery can be attached in a simple fashion to the chair back rest in an elastically resilient manner. This object is achieved according to the invention by means of a spring arranged indirectly between a back rest support of the chair back rest and the back rest support upholstery. The provided attachment saves space and is independent of the design of the back rest support, which can also be rigid.

An object of the invention is to assure a sturdy apparatus which acts to hinder a rotation of the lower back support upholstery about an axis which is arranged essentially vertically to the back rest support and runs above the seat of the chair.

Another object of the invention is to provide a tilting lever for the acting of a force on the upper end of the lower back support upholstery, by which means the lower back support upholstery can deflect, particularly at its upper side.

Yet another object of the invention is to make possible a simple attachment of the spring to the lower back support upholstery.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF A PREFERRED EMBODIMENT

Figure 1:
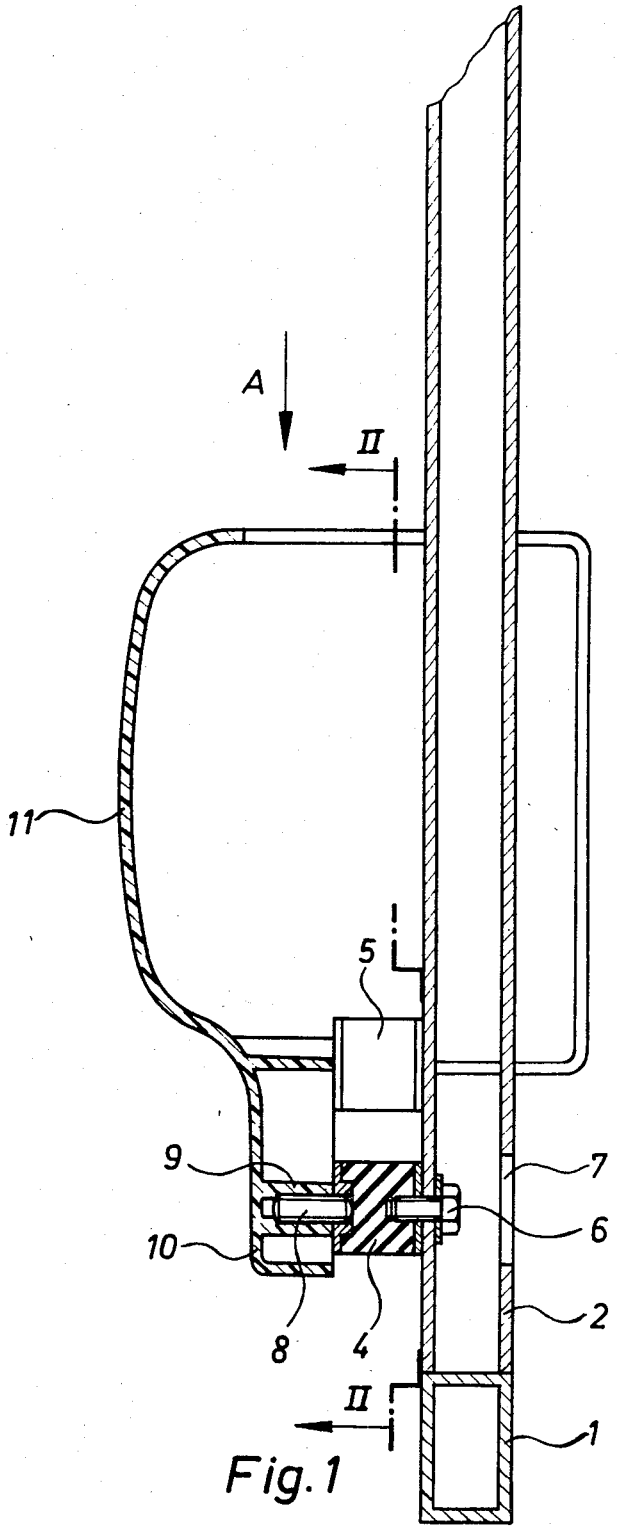
FIG. 1 is a cross-section along the line I—I in FIG. 2, showing a portion of a chair illustrated schematically as an exemplary embodiment of the invention.

In the center of a cross support 1, which is pivotable about a horizontal axis, is attached an essentially perpendicular back rest support 2. Both supports consists of a tube which is rectangular in cross section. Identical springs 3 through 5, which are arranged in a triangular and are formed as rubber-metal elements, are each attached to the back rest support 2 by means of respective screws 6, which penetrate a wall of the back rest support and are screwed into the adjacent metal portion of the associated spring with a washer arranged between the screw heads and the back rest support. In order to provide access to the screws 6, the back rest support has an access hole 7 in its opposite wall. The metal element provided on the other side of the spring supports a threaded bolt 8, which is screwed into a tubular element 9, which, in turn, is arranged on the back side of a lower connecting piece 10 of a holder 11 for a lower back support upholstery (not shown). This lower back support upholstery is arranged on the other side of the back rest support 2 and is inserted into the ends of the holder 11. Viewed from above, the holder 11 and the lower back support upholstery give the back rest support 2 the shape of a narrow rectangle, the longitudinal sides of which are bowed.

Figure 2:
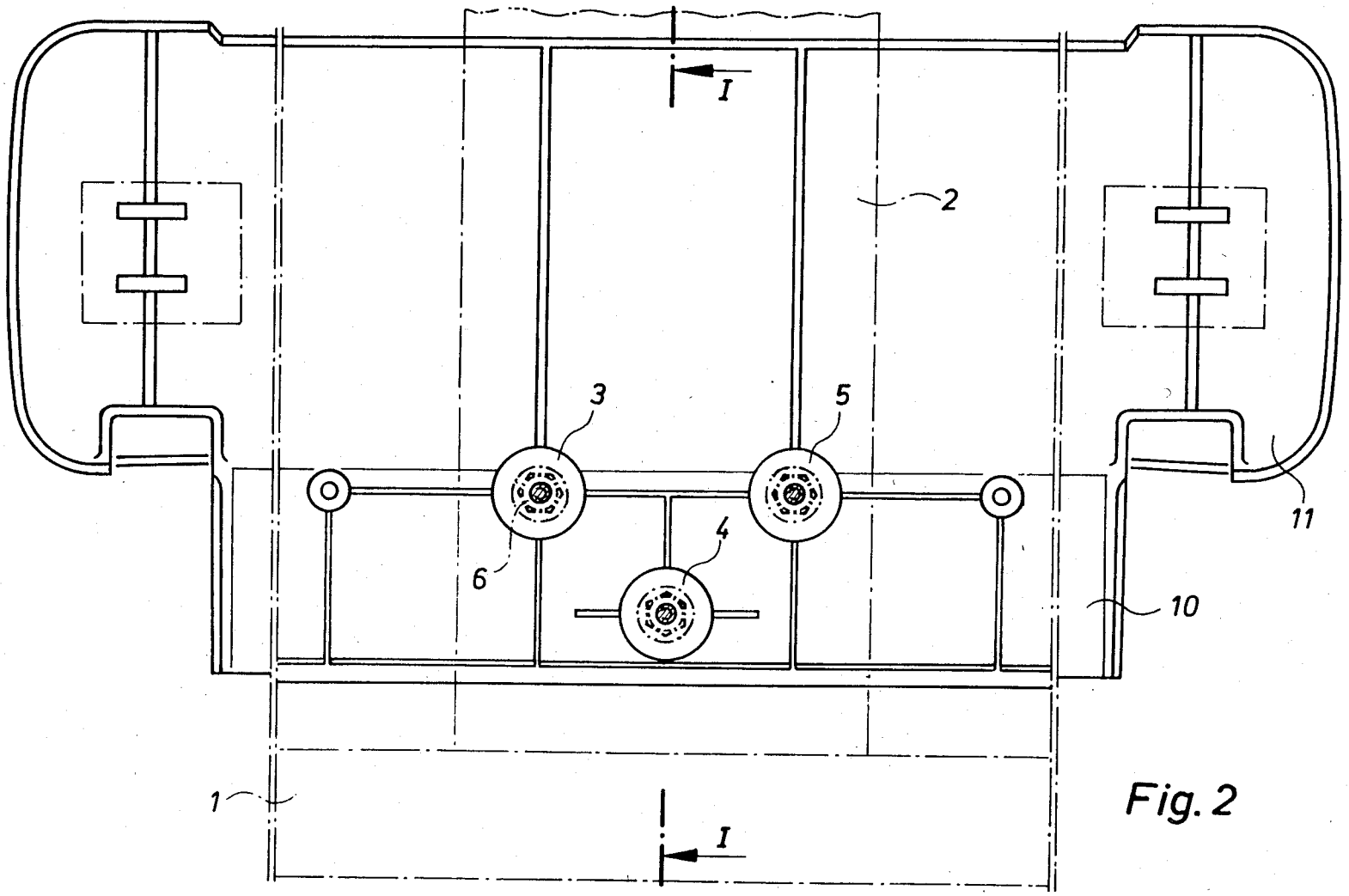
FIG. 2 is a cross-section according to the line II—II in FIG. 1 in which the elements lying in front of the section plane are illustrated with broken lines.
Figure 3:
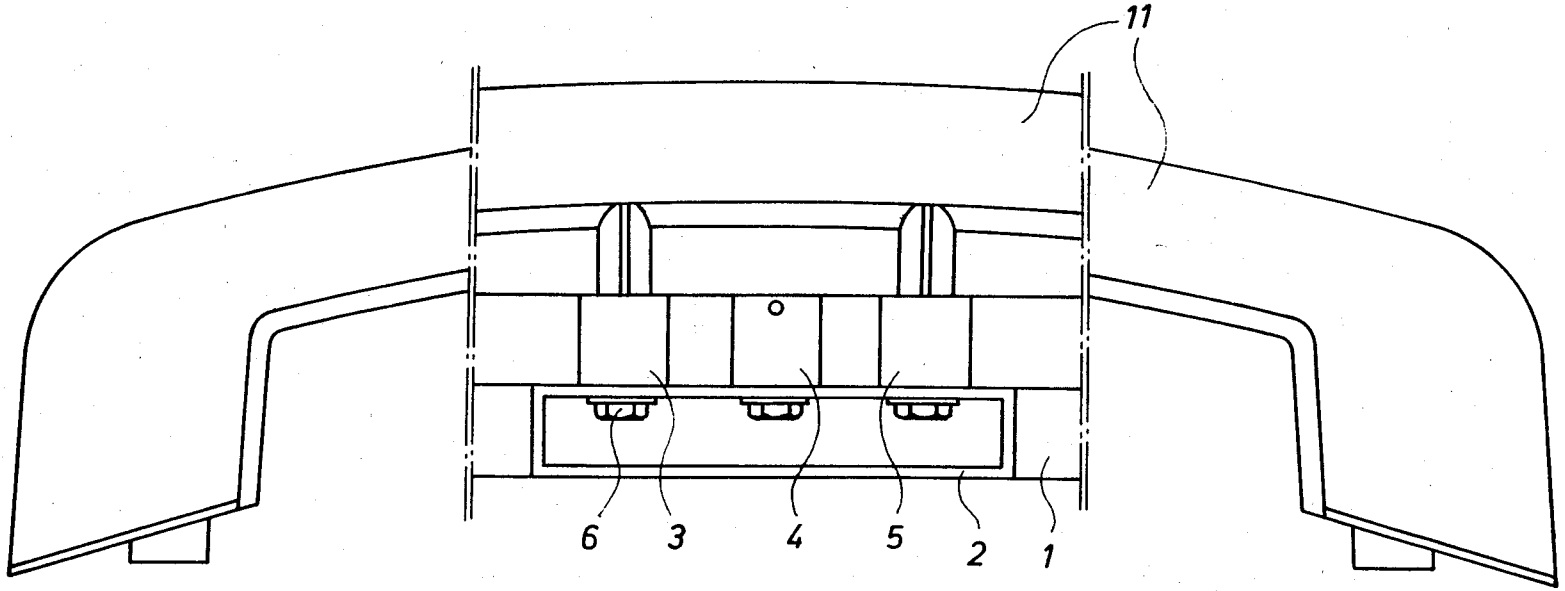
FIG. 3 is a top view in the direction of the arrow A in FIG. 1.

As illustrated in FIG. 2, the three springs 3 through 5 are arranged in the shape of an isosceles triangle, whereby the upper, longer side runs horizontally. These springs alone support the lower back support upholstery together with the holder 11. The lower back support upholstery extends, like the holder 11, over the width of the chair seat and has upholstery on the side facing the chair seat. The abutting ends of the holder 11 and the lower back support upholstery are bent backwards.

The springs 3 through 5 make it possible for the lower back support upholstery to yield in a horizontal direction, to perform a tilting movement and also make possible a limited resiliency in a perpendicular direction. When the user of a seat provided with the apparatus described herein rests against the lower back support upholstery, the springs 3 through 5 are loaded in tension.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. An apparatus for the attachment of a lower back support upholstery by means of a spring to a chair having a back rest, comprising a spring arranged between a side of the back rest support of the chair and the lower back support upholstery, said spring consisting of an elastic material, wherein the spring for the lower back support upholstery is arranged at the lower end of a holder for the support upholstery;

the lower back support upholstery being offset horizontally with respect to the back rest support such that the spring allows horizontal pivoting as well as limited downwardly vertical movement of the lower back support upholstery.

2. The apparatus according to claim 1, wherein three springs are provided, which are formed as rubber-metal elements and are arranged in an isoceles triangle, whereby one of the sides of the triangle runs horizontally.

3. The apparatus according to claim 1, wherein the holder for the lower back support upholstery has a connecting piece on its lower side, and the spring is arranged between this connecting piece and the back rest support.

4. The apparatus according to claim 1, wherein at least one tubular element is provided on the connecting piece of the holder for the attachment of one side of the spring.

5. The apparatus according to claim 1, wherein the back rest support is formed as a four-sided tube for the attachment of the spring to one of its flat sides by an attachment means, and the spring is attached to the four-sided tube on the side opposite the lower back support upholstery, whereby the attaching means is accessible by means of an access hole provided on the side of the four-sided tube facing the lower back support upholstery.

6. A back rest for a chair, comprising:

means for supporting the back rest;

an upholstery holder having a base at its lower end;

connecting means mounted at the base of the upholstery holder; and spring means for interconnecting the connecting means to a side of the supporting means;

whereby the upholstery holder is supported in a cantilevered mode;

the upholstery holder being offset horizontally with respect to the back rest support such that the spring means allows horizontal pivoting as well as limited downwardly vertical movement of the lower back support upholstery.

7. The back rest of claim 6, wherein the spring means comprises an elastomeric block.

8. The back rest of claim 6, wherein the spring means comprises three elastomeric blocks arranged in an isosceles triangle.

9. The back rest of claim 6, further comprising a tubular element on the connecting means for the attachment of the spring means.

10. A back rest for a chair comprising:

a vertically extending back rest support;

a holder for upholstery;

a connecting piece integrally attached to the lower end of the upholstery holder;

a tubular element extending horizontally within the connecting piece; and spring means interconnecting the tubular element to a side of the back rest support.

11. The back rest according to claim 10, wherein the spring means comprises three elastomeric blocks.

12. The back rest according to claim 11, wherein the upholstery support is connected to the back support only by the spring means.

* * * * *